United States Patent [19]

Hendrischk

[11] Patent Number: 4,518,270

[45] Date of Patent: May 21, 1985

[54] MULTICOLORED PRINTING

[75] Inventor: Wolfgang Hendrischk, Neu-Ulm, Fed. Rep. of Germany

[73] Assignee: Mannesmann Aktiengesellschaft, Duesseldorf, Fed. Rep. of Germany

[21] Appl. No.: 480,171

[22] Filed: Mar. 29, 1983

[51] Int. Cl.[3] ..... B41J 35/16

[52] U.S. Cl. ..... 400/240.4; 400/124

[58] Field of Search ..... 400/121, 124, 240.4, 400/611, 616–616.3, 240

[56] References Cited

U.S. PATENT DOCUMENTS 4,280,767 7/1981 Heath ..... 400/240.4 X

OTHER PUBLICATIONS

*IBM Tech. Disc. Bulletin*, by J. H. Meier, vol. 21, No. 11, Apr. 1979, pp. 4448–4451.

*IBM Tech. Disc. Bulletin*, by D. W. Skinner et al., vol. 21, No. 5, Oct. 1978, pp. 1828–1829.

*Primary Examiner*—Paul T. Sewell

*Attorney, Agent, or Firm*—Ralf H. Siegemund

[57] ABSTRACT

A matrix printer is operated with a multicolor band ink ribbon which changes position vis-a-vis print styli. Through a combination of paper shifts and ribbon position shifts, as well as selective control of the styli, multicolor areas are sequentially composed.

6 Claims, 47 Drawing Figures

10C
C4
C1
C2
C3
M1
M2
12
11
1 2 3 4 5 6 7 8 9

10B
C4
C1
C2
C3
M1
M2
12
13
11
1 2 3 4 5 6 7 8 9

10A
C1
C2
C3
M1
M2
12
14
11
1 2 3 4 5 6 7 8 9

I

II

III

IV
M2
M1
C3
C3+C2
C3+C1
C3+C2 +C1
15
1
2
3
4
5
6
7
8
9

1/2/3

V
VI
VII
VIII
C3+C1 +C2
C3 +C1
C3
M2
15
C3+C1 +C2
C3
M2
15
C3+C2
C3
M2
C3+C2+C1
C3+C1
M1
1
2
3
4
5
6
7
8
9

I
II
III
IV
M1
M2
C1
C1+C3
7
8
9

V
VI
VII
VIII
M1
M2
C1+C3+C4
C1+C3+C4 +C2
C1
C1+C3 +C4
C1+C3 +C4+C2
C1+C3
1
2
3
7
8
9

1/2
4/3

I
M2
7
8
C3

II
M2-5
C3+C2
7
8
C3

III
M2-5
4
C3+C2
7
8
C3

IV
M2-5
4
1
2
C3+C2
+C1
C3+C2
7
8
C3

V
VI
VII
M1
M2
M2
1
2
3
4
5
6
7
8
C3+C2+
C1+C4
C3+C2
+C4
C3+C4
C3+C2
+C4+C1
C3+C4
+C2
C3+C4
C3
C3+C2+C4
+C1
C3+C4+C2
C3+C2
C3

MULTICOLORED PRINTING

BACKGROUND OF THE INVENTION

The present invention relates to multicolor printing, preferably under utilization of a matrix printer, and further under utilization of a multicolor ink ribbon which is adjustable to assume several different positions relative to the print head.

Generally speaking, a printer of the type to which the invention pertains is usually constructed with a print head which is movable transversely to the print medium such as sheet stock being printed on, which sheet stock is transported in between print passes by advancing the printing by one line of character printing whereby each such advancement occurs after one or two transverse passes by the print head. The print head itself has one or several columns of print needles, wires or styli for purposes of generating individual characters through selective activation and forward propulsion of individual styli. For purposes of providing multicolor printing particular ink ribbon mounting and displacing structure has been suggested by me and another, see for example U.S. Pat. No. 4,395,148 (Ser. No. 253,874, filed Apr. 13, 1981—allowed). In addition, IBM TDB Volume 24, December, 1981, pages 3276 through 3278 discloses an alternative solution for placing a multicolor ribbon into several different positions.

Aside from the problem of placing the appropriate ribbon track in front of the column of print styling, the multicolor print control itself poses problems. Generally speaking, printers are constructed which permit control and utilization of just two colors. Printing in more than two colors requires a different construction in the printer. Moreover, conversion of an existing printer and its controls, construction and mechanism to a multicolor configuration is often quite difficult, or not feasible.

DESCRIPTION OF THE INVENTION

It is an object of the present invention to provide a new and improved arrangement and method for operating a matrix printer having a print head which moves parallel to the plane of printing to obtain selected multicolor and regular alphanumerical printing whereby particularly in the latter case the print speed is not to suffer because of the features that relate to the multicolor operation.

In accordance with the preferred embodiment of the present invention, it is suggested to provide a color ribbon with three strip like ink areas of different color and constant width, the ink or dye being composed of colors to be mixed or mixed colors, but one or several of the ink areas have a width larger than a group of print styli tips within the column of styli, or even larger than the length of the column of styli tips. Such a printer offers the advantage that its construction as such can remain but selective operation for monocolor alphanumeric printing or multicolor printing such as used in the transposition of graphics is now made possible on "old" machines. Another advantage is to be seen in that one color should be in the relation of one to three in the case of a total of four colors, and this particular color should be blue or black. Therefore the printer has a threefold, probably even more than a fivefold higher color capacity, and is therefore well suited for a monocolor printing, in addition with its color composing capability.

In accordance with a particular feature, and here particularly the operational method of the invention, it is suggested that the multicolor ribbon have at least three or more different bands of color areas in the field, and is adjustable relative to the print head (or the latter is adjustable to the former) in at least two positions, and a cyclical operation is carried out, each cycle consisting of several printing passes and within a cycle, different groups of styli prints cooperate with different color bands of the ink ribbon and previously resulting "gaps" are bridged by vertical adjustment of the printing medium while in each cycle there is at least one pass in which the print head and ink ribbons have a different position in relation to each other. Generally speaking, a printer provided, for example, for two color printing but under utilization of a three or four color band ribbon can be operated as a three or four color printer simply through appropriate control of the styli, of the paper advance in between some of the passes and through relative shift of the ribbon from one to the other position for particular ones of the passes.

In accordance with a first embodiment, the method can be practiced in that during startup dots with one or two colors are printed and after the completion of the startup the paper is advanced following each printing pass and by a length equal to the height of the group of styli used in a particular pass and that between paper advance respective groups of newly printed colored dots as well as group of overlapping or superimposing color dots are being printed and that in the last print pass of a cycle at least one group of print dots is completed as to all desired colors.

For practicing this method in detail, the color ink ribbon should have at least three color bands, a wide one and two narrower ones, and one prints in cycles of at least four passes whereby respective prior to the second and third passes the paper is shifted in vertical, i.e. columnar, direction for a length equal to the height of a group of styli operated in common, and prior to the fourth pass the ribbon changes position such that during the fourth pass the column of styli faces the wide band while in the remaining passes the center of the column is centered on the boundary between the two narrow color bands.

In accordance with another mode of practicing the basic method in accordance with the invention, it is suggested that before and after each pass the ribbon is shifted into the respective other position and subsequently the paper is advanced and that during startup two or three colors are printed and after the startup, printing is completed through several spaced apart groups pertaining to the same column of styli. This particular method is practiced by means of a multicolored ink ribbon having four bands, two upper ones and two lower ones, and the two different ink ribbon positions differ in that the column of a styli is centered on the boundary between the two upper bands in one of the ink ribbon positions, while the column is centered on the boundary between the lower two bands and the other ribbon position. Printing is carried out in two cycles of at least two sequential passes, however after every second print pass the paper is shifted vertically by a distance equal to the height of a group of needles operated in common, and prior to each printing class the ribbon is changed as to its position.

In accordance with another mode of practicing the invention, it is suggested that during the startup one or more colors are printed and wherein following each print pass the paper is advanced by the height of a group of the print needles operated in common and that after the startup the position of the ribbon changes for one pass and thereafter each following print pass the paper is again advanced by the particular spacing. That cycle is completed through sequentially occurring print passes and concurring printing of several colors in a single print pass under utilization of several groups of needles, each one printing in a different color. This particular method is practiced by means of a multicolor ink ribbon having four color bands, a wide one and three narrower ones. In a first print position the columm of needles and styli faces all three narrow ribbons, and in the second position all styli face the wide band. At least four printing passes are carried out in the first mentioned position of the ink ribbon and one pass within a cycle is carried out in which all styli face the wide ink ribbon. The paper is shifted by a vertical distance equal to the vertical height of a group of needles operated in common prior to each pass in which the styli face all three narrow color bands.

It should be mentioned that the invention constitutes the fact that the usual paper transport steps are 1/120", 1/144" or 1/72". It should be mentioned further that in all instances in which one color band is as wide as the column of styli is high, high speed uni-color printing can be obtained in the color of that band without requiring any ribbon change.

DESCRIPTION OF THE DRAWINGS

While the specification concludes with claims particularly pointing out and distinctly claiming the subject matter which is regarded as the invention, it is believed that the invention, the objects and features of the invention, and further objects, features and advantages thereof will be better understood from the following description taken in connection with the accompanying drawings in which:

FIGS. 1A*a*, 1B*b* and 1C*c* illustrate in different circles symbolically a representation of different color areas as used in conjunction with round, i.e. circular, styli tips and for representing color compositions of individual dots, herein FIG. 1A*a* is associated with FIG. 1*a* et seq, FIG. 1B*b* is associated with FIG. 1*b* et. seq, FIG. 1C*c* is associated with FIG. 1*c* et seq.

FIGS. 1*a*, 2*a* through 13*a*, are schematic illustrations of progressive printing steps in accordance with the first example under utilization of the ribbon shown in FIG. 1A;

FIGS. 1*b*, 2*b* through 11*b* illustrate schematically the progression of printing in accordance with another example using the ribbon shown in FIG. 1B; and FIGS. 1*c*, 2*c* through 17*c* are schematic illustrations of progressive printing in accordance with another example using a color ribbon as shown in FIG. 1C.

Proceeding now to the detailed description of the drawings, FIGS. 1A, 1B and 1C, illustrate three different ribbons 10A, 10B and 10C, which are physically similar as far as overall width is concerned, but in which the various strip-like color dye areas are differently wide. In particular, the ribbon 10A in FIG. 1A is comprised of and includes a rather wide blue field and area C1, a considerably narrower field C2 which, for example, is green, and a somewhat wider area C3 which, for example, is red. This color distribution is by way of example only. Generally speaking and considering all colored fields in FIGS. 1A, 1B and 1C, one should have either field C1 or C4 black or blue, and the others may have the colors green, red and yellow, if that kind of color pattern is needed. Alternatively, one could use cyan and magenta instead of blue and red. Only yellow, which is difficult to produce as a mixed color should be used directly in one of the areas if yellow is positively desired. Black is also used directly.

Figures 1A, 1B, 1C:
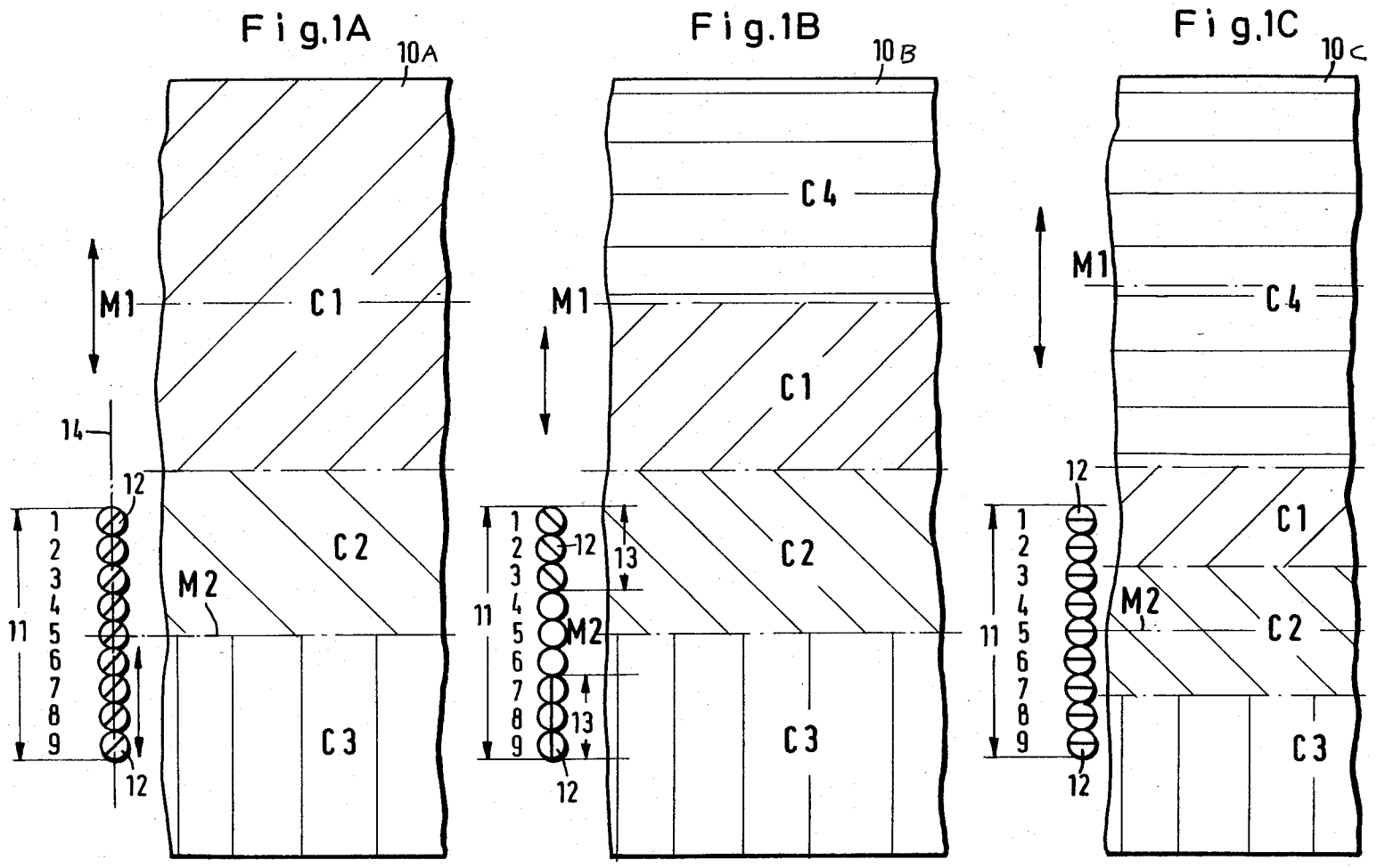
FIGS. 1A, 1B and 1C illustrate portion of multicolor ink ribbon to be in accordance with the preferred embodiment of the present invention, showing different width dimensions and distributions in the color areas, each Figure moreover includes representation of association with a column of print dots, or styli tips.

The Figures also illustrate a column of print dots. However, the column can also be interpreted as the front view of the operating tips of altogether nine print needles identified by numbers 1 through 9. Reference numeral 11 denotes the height of a complete column, while reference numeral 13 denotes, for example, the height of a group of, for example, three juxtaposed dots-tips. The dots, styli and needles of such a column define also a needle or styli, axis 14 of columnar alignment.

In view of the fact that the inventive system refers to equipment as it is illustrated and described in U.S. Patent (supra) and others, general reference may be made to the fact that the ribbon 10 may be adjustable into two positions, M1 and M2. This then is the reason for applicability of the invention too simple machines: only two ribbon positions are to be provided for, the invention can be provided with the particular ribbon and particular control patterns for multicolor printing.

The position M1 of ribbon 10A is defined by a location in which the ink or dye field C1 is fully in front of all dot producing styli tips while the position M2 of adjustment of the ink ribbon 10A is defined by the fact that the border between the fields C2 and C3 runs through the middle one of the 9 dots, i.e., faces centrally the tip of needle 5. Generally speaking, the head with the styli could be adjusted relative to the ink ribbon. For purposes of this invention, it is only required that head and ink ribbon are adjustable in the direction 14 of extension of the column, and it is basically immaterial which portion is the movable one though for practical reasons moving the ink ribbon up and down is preferred.

The arrow 15 denotes the relative movement between the medium to be printed on and the print head. Usually, of course, it is the print head which is being moved. This printing medium is usually a long sheet with perforated edges made moveable basically in the direction of extension of the columns, preferably in steps by sprocket action or at a constant speed depending on the style or mode of printing. It should also be mentioned that more than one print columns could be used in order to print in in-between dot positions, i.e., in order to permit the printing of overlapping dots in the vertical. These multiple columns may be adjustable in relation to each other. Also the number of needles and styli in the column and the number of a complete vertical line of print dots does not have to be 9. One may use a smaller number of styli and dots-per-column, such as 6 or 7 regular print heads with different numbers of styli are on the market here.

Proceeding now to the description of FIGS. 1*a* through 13*a* in relation to FIG. 1A, it is repeated that the three fields C1, C2 and C3 respectively denote blue, red and green color areas. It is furthermore assumed that in a first pass the needles are oriented in respect to the ribbon 10A as is in fact shown in FIG. 1A. During this pass, needles 7, 8 and 9 face the green area C3; needles 1 through 6 may not be operated. Hence, during this first complete pass only the three needles 7, 8 and 9 participate in the printing process and print green dots. Accordingly, the dots are hatched corresponding to the symbolic representation (FIG. 1A*a*) in that "green" is represented by hatching are "3" (as per FIG. 1A*a*).

Figures 1A, 2A, 3A, 4A, 5A, 6A, 7A:
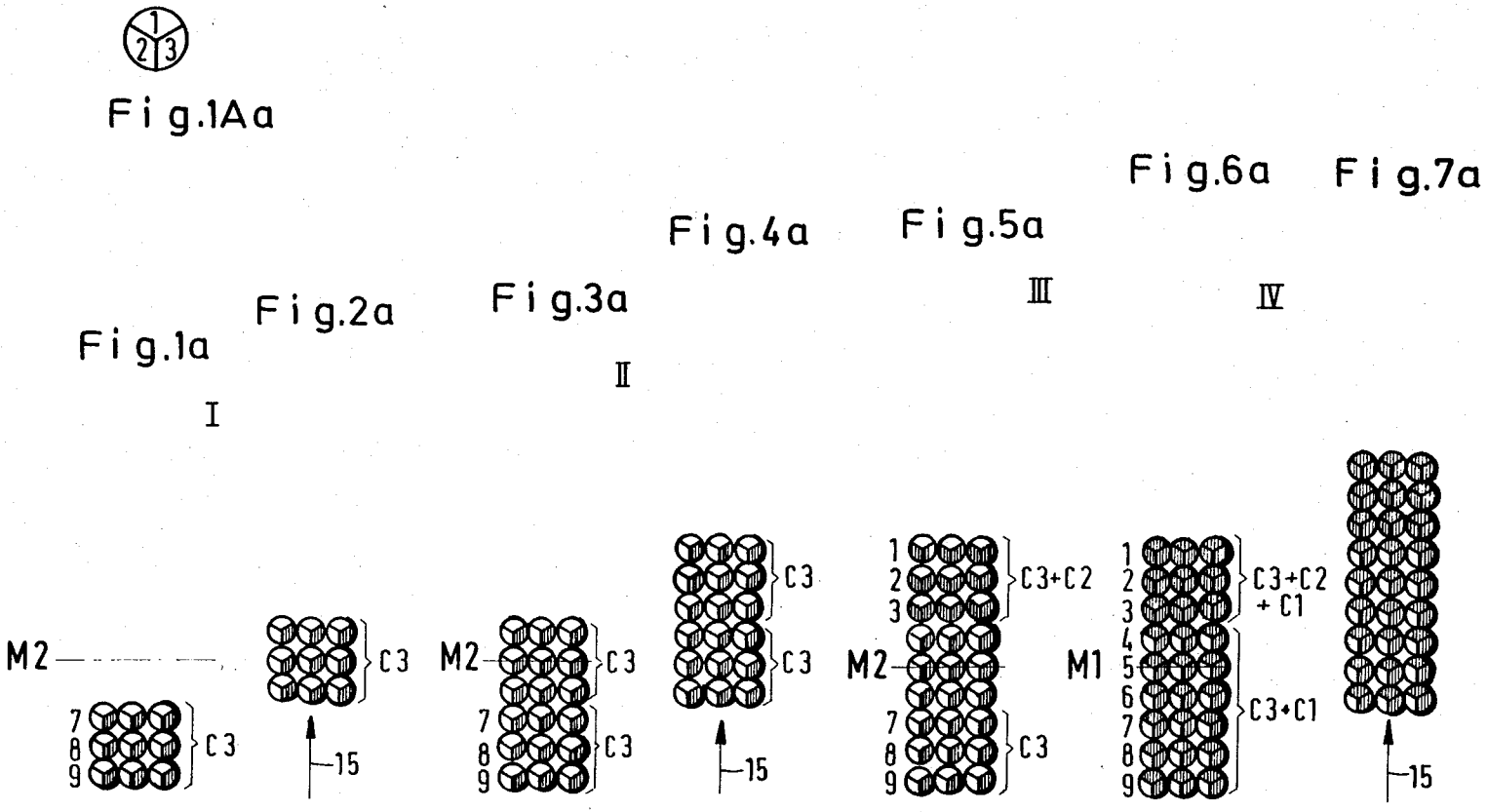

A particular "greenish" square, for example, will then be printed as shown in FIG. 1*a*, the position of the ribbon is identified by M2. Subsequently, i.e. upon completing this one pass, the print sheet may be advanced in the direction of arrow 15, which as shown in FIG. 2*a*, displaces, for example, the particular greenish square that has been printed by a particular distance which is to be equal to the width of three dots. This means that in a second pass and again using only needles 7, 8 and 9 a second green square will be printed underneath the first one because the relative position (M2) between the ribbon and print head has not changed and the second pass finds the ribbon-print head arrangement vis-a-vis the print sheet in which the latter is displaced by just the width of three aligned dots (FIG. 3*a*). Of course, the timing of styli actuation has to be selected appropriately in order to vertically align the first printed square with the second printed square.

Prior to a third pass, the print sheet is again advanced in the direction of arrow 15 by the same kind of vertical displacement equal to the width of three dots which displacement is illustrated in FIG. 4*a*, and now during the next, i.e. the third, print pass (FIG. 5*a*) the previous operation is repeated, i.e. another square is added. However, in addition and during this same third pass, needles 1, 2 and 3 are also activated and it will be recalled that these needles are in front of the color field C2, by means of which red is printed, to that, a square of the color red is superimposed upon the previously and initially (FIG. 1*a*) printed green square.

Prior to the fourth print pass, the ribbon is shifted into position M1 so that prior to this pass all styli face the blue area C1. Now all nine needles in the fourth print pass superimpose blue upon the previously printed rectangle. The upper portion of that rectangle contains now all three colors in superimposed relation while the lower two-thirds combine the colors blue and green only. Following the fourth print pass, the sheet is again advanced in the direction of arrow 15 (FIG. 7*a*).

The example as explained is, of course, completely arbitrary. As far as the result is concerned, it was simply assumed that a rectangle as shown in FIGS. 6*a* and 7*a* was to be printed. It can readily be seen that after just four print passes, one does already obtain an image which does, in face, include all three colors in selected proportions. For example, if none of the styli were actuated in the first pass, the upper square of the rectangle (FIG. 6*a* or 7*a*) would be just red-plus-blue.

It can thus be seen that the operation requires generally the following steps: paper advance, superimposing a color upon an already existing color field as printed (if needed) and newly printing a single area with one particular color (if desired). These steps are cyclically repeated whereby after the completed start up, each following pass or the next one, in effect, adds three additional full color printed column to previously printed pattern.

Figures 1A, 8A, 9A, 10A, 11A, 12A, 13A:
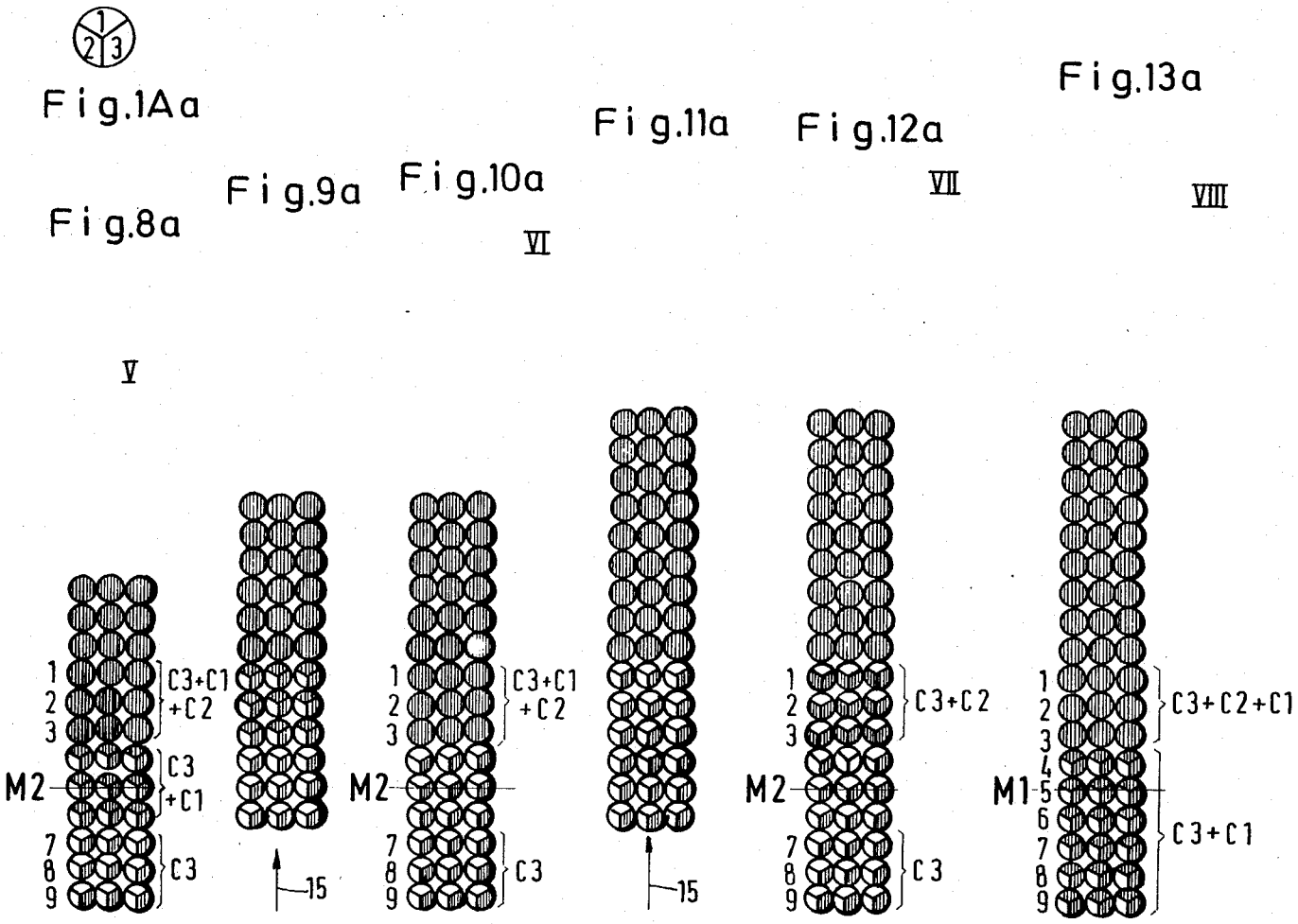

After advancing the paper again by a length equal to the width of three dots, the ribbon is returned to the position M2 as shown in FIG. 8*a*, so that the needles 1, 2 and 3 face the color field C2 and the needles 7, 8 and 9 face the color field C3. Printing is now carried out in a fifth pass and the FIG. 8*a* illustrates the effect this particular pass has on the previously printed rectangle; another green square is added to the bottom. FIG. 9*a* shows another paper advance step and FIG. 10*a* illustrates the printing step of the sixth pass as well as the color combination obtained as directly discernable from the hatched labelling in this Figure, and of course another green square is added to the bottom of the rectangle.

Following another paper advance step (FIG. 11*a*) and still retaining the ribbon in the position M2, the seventh pass repeats in fact the passes 5 and 6, but in the seventh pass a completely arbitrary color combination is not obtainable, C1 is missing. In the succeeding, eighth pass, (FIG. 13*a*) the ribbon will change to the position M1 for printing in the C1 color whenever needed in the rectangular portion composed of those squares underneath that portion that was completed by pass 6 and now again a completion of, in fact, any color combination as per the needles 1, 2 and 3 is obtainable with this 3-square area. Needles 7, 8 and 9 in particular add the green to the previously printed red.

During further printing passes which are not shown, the printing is advantageously accelerated for obtaining arbitrary color combinations, as for example, represented in FIG. 13*a* by the combinations C3 plus C1 as per six needles 4 through 9. However, it should be observed that the fourth and eighth passes are, in fact, identical. After the fourth and after the eighth pass, therefore, another cycle is produced which may be different from the preceding one as described.

Proceeding now to the description of FIGS. 1*b* through 11*b* in conjunction with a four color ribbon 10B, it is assumed that this particular ribbon has the blue field C4, a red field C1, a green field C2, and a yellow field C3. The positions differ by placing two pairs of different colorbands in front or the upper and the lower three styli. When in a position M1, needles 7, 8 and 9 print red (C1) and for example, needles 1 through 6 are not operated during this first pass, but then could print C4. Thereafter, ribbon 10 is shifted to the position M2 (FIG. 2*b*) and a second pass is printed whereby in the case of using again the three needles 7, 8 and 9, the color C3 is superimposed upon the square printed in the color C1. One could print another square with the colors C2 above the previously printed square if that were desired and part of the pattern to be printed.

Figures 1B, 2B, 3B, 4B, 5B, 6B:
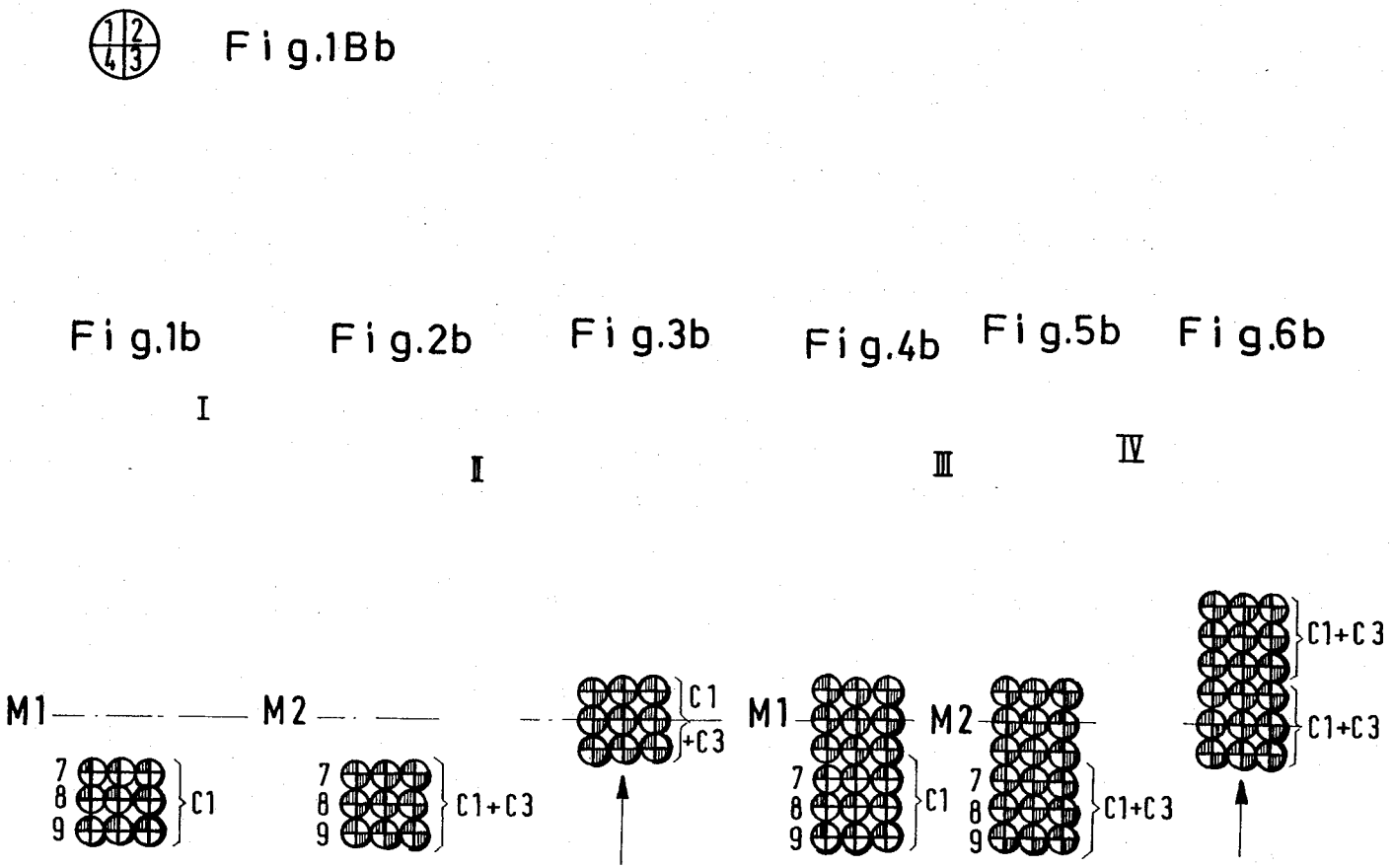

In accordance with FIG. 3*b*, the paper is again advanced in direction of arrow 15 by a length equal to the width of three dots, and the ribbon is again returned to the position M1. In the third pass (FIG. 4*b*) needles 7 through 9 add a square in the color C1 to the previously printed square. After another change of the ribbon position back to position M2, the fourth pass adds the color C3 (needles 7, 8 and 9) to the square printed in the color C1 during the previous pass. Therefore, at the end of the fourth pass (FIG. 5*b*) a rectangle combining the colors C1 and C3 has been obtained. As per FIG. 6*b*, the paper is advanced again by the particular step length in question.

As can be seen, the four printing passes 1 through 4 resulted in a coloring consisting of two colors, but during each pass certain other colors could have been added if that had been desired. Hence, a complete 4-color pattern can be completed in these four passes.

Figures 1B, 7B, 8B, 9B, 10B, 11B:
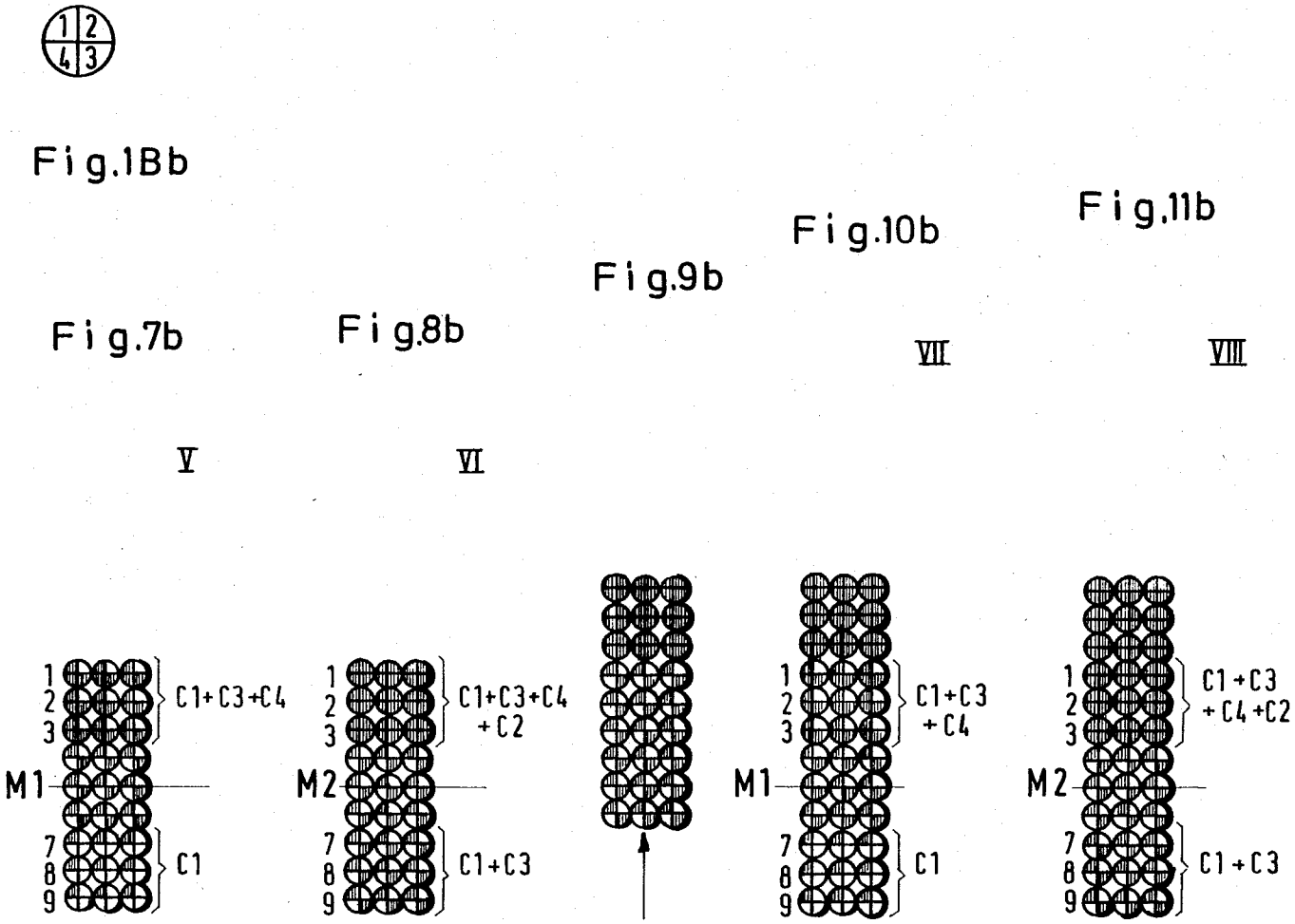

Beginning with a pass 5 as shown in FIG. 7*b* the ribbon 10B is repositioned to assume the position M1 and printing occurs under utilization of the color fields C4 and C1 using respectively needles 1, 2 and 3; and 7, 8 and 9. The next printing pass is depicted in FIG. 8*b*. It is the sixth one in the series and is preceded by moving the ribbon 10B back into the position M2. Now, needles 1, 2 and 3 add the color of the field C2 to the highest square in the rectangle while the needles 7, 8 and 9 are preparing the completion of the print by adding C3 to the lowest square previously printed.

At this point, startup has been completed (as far as a nine-dot-high column is concerned) so that thereafter, more or less continuously, color printing can be carried out, i.e. the cycle to be described next can be repeated indefinitely, if that is desired. Accordingly, the cycle begins with a paper advance by the usual distance (FIG. 9*b*) and the ribbon 10B is shifted to position M1. FIG. 10*b* illustrates the seventh printing pass, which corresponds essentially to pass 5.

In accordance with the previous description, one can readily see that following the startup procedure only three passes of printing are needed per cycle for printing, in fact, in color and in any arbitrary color combination, as well as on a continuous basis. In particular, during the seventh pass needles 1, 2 and 3 cooperate again with the color field C4 and needles 7, 8 and 9 cooperate with C1.

The following, eighth printing pass is preceded by shifting the ribbon from position M1 to position M2, and the printing corresponds to the pass 5 or 6, so that in accordance with FIG. 11*b*, needles 1, 2 and 3 complete a four color configuration in the square that is in front of them. On the other hand, the needles 7, 8 and 9 provide a second color for the previously printed, lowest square. The lowest square was printed with the color C1, and the color now added is derived from the field C3. The now continuing cycle corresponds to those previously described and can be repeated as often as desired. In summation, this method provides that the first six printing passes create three four-color rows of printing dots so that each two printing passes add three further rows of dots in different colors.

Figures 1C, 2C, 3C, 4C, 5C, 6C, 7C:
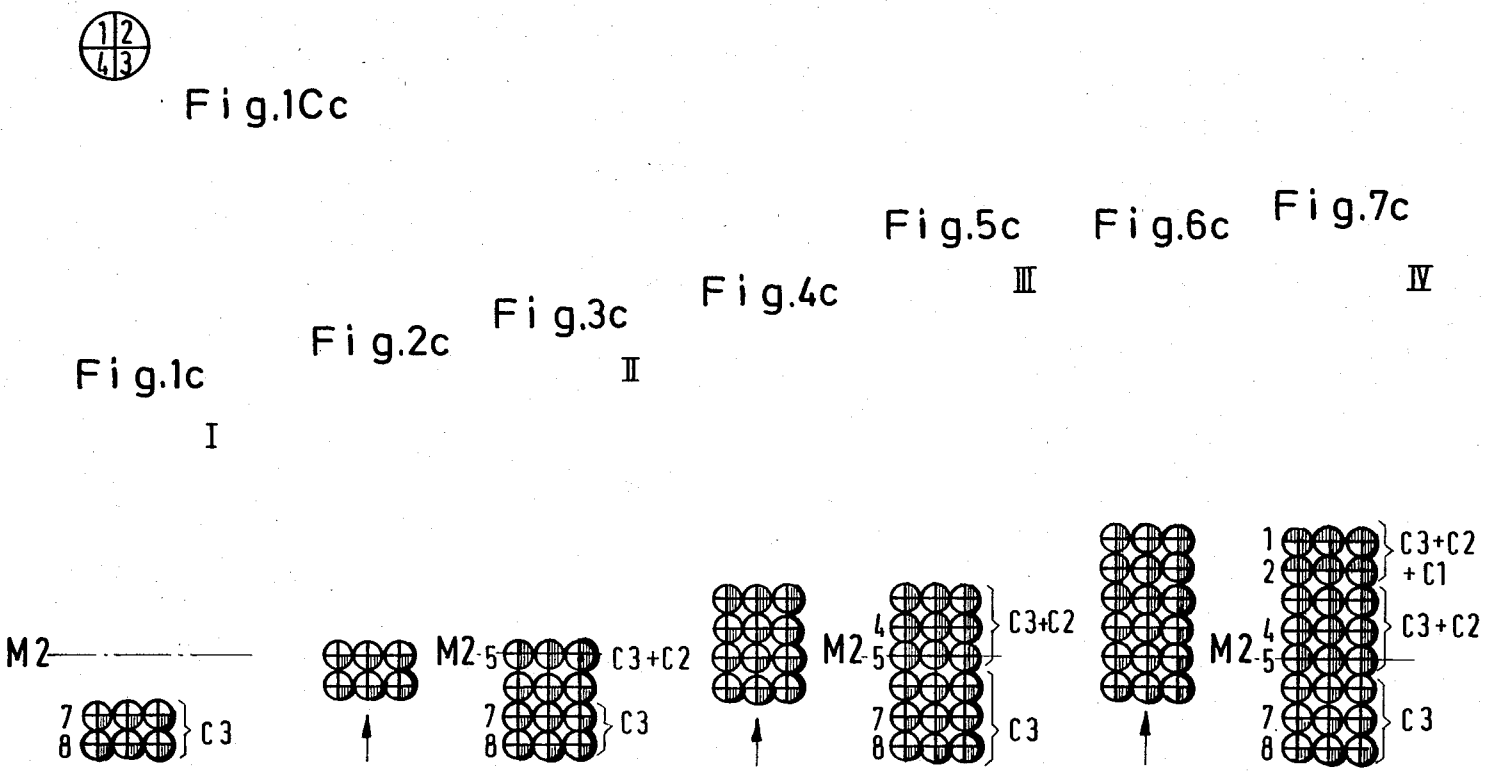

Proceeding now to the third example, which uses the particular ribbon shown in FIG. 1C, the sequence of operation is illustrated in FIGS. 1*c* through 17*c*. Beginning with FIG. 1*c*, the initial field being printed consists of a pattern generated by only two needles 7 and 8. It should be mentioned, of course, that the labelling of needles has remained consistent throughout and will so remain. The position of the ribbon in front of the print head is M2, needles 7 and 8 face field C3. Following this first printing pass, the paper is advanced but now by only two dot diameters or widths to assume the position as shown in FIG. 2*c*. The paper advance in this particular example is always limited to that particular two dot diameter shifting length.

The second printing pass is depicted in FIG. 3*c* and here the single row 5 cooperates with color field C2 and the two needles 7 and 8 cooperate with the color area and field C3. Therefore, the printing at this point is carried out by needles which are not all contiguous. The paper is again advanced by two dot diameters as per FIG. 4*c* but the position M2 is still maintained for the third printing pass as shown in FIG. 5*c*. In this particular case, two needles 4 and 5 are used to print in cooperation with the color field C2 and the needles 7 and 8 cooperate with color field C3.

Following this third pass, paper is advanced by the width of two needles as per FIG. 6*c* and the fourth pass as depicted in FIG. 7*c* uses six needles wherein needles 1 and 2 cooperate with the color field C1, the needles 4 and 5 cooperate with color field C2 and the needles 7 and 8 shall cooperate with color field C3. The ribbon position for the passes 1 through 4 has been consistently the position M2.

Following the fourth pass the ribbon position is changed to M1 and now eight needles, 1 through 8, are all in front of the wide color field C4 and they print (or may print) concurrently the color C4 on top of whatever printing pattern exists at that point. Thereafter, the paper is shifted by the usual two dot width step (FIG. 9*c*) and the ribbon 10*c* is again shifted back to the position M2 so that the sixth pass can again be carried out with two needles per color field C1 and C2 but only the field C1 is used in conjunction with the needles 1 and 2, while the needles 7 and 8 add the color C3 to the bottom of the rectangle. It can thus be seen that actually the start up procedure is terminated with the fifth pass and the continuous color printing is carried out from pass 6 forward.

Figures 1C, 8C, 9C, 10C, 11C, 12C, 13C:
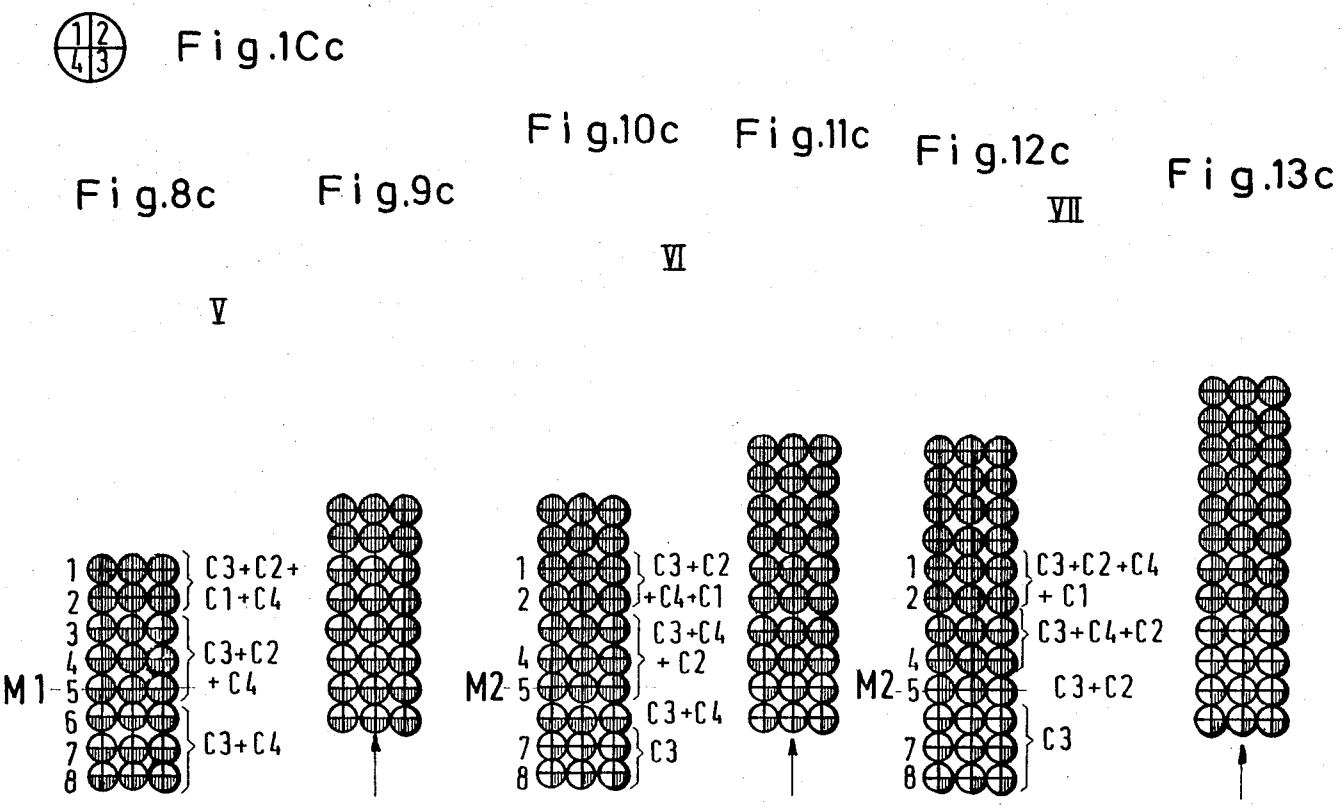

In the next step, of course, there is again a shift by the two dot width, as shown in FIG. 11*c*, and the color ribbon position M2 is maintained so that in the seventh pass as shown in FIG. 12*c*, three different colors are simultaneously printed, namely, the needles 1 and 2 print with a color field C1 and the needles 4 and 5 cooperate with the field C2 and the needles 7 and 8 cooperate with fields C3 whereby, in fact, two of those dots are completed in a multicolor configuration.

Figures 1C, 14C, 15C, 16C, 17C:
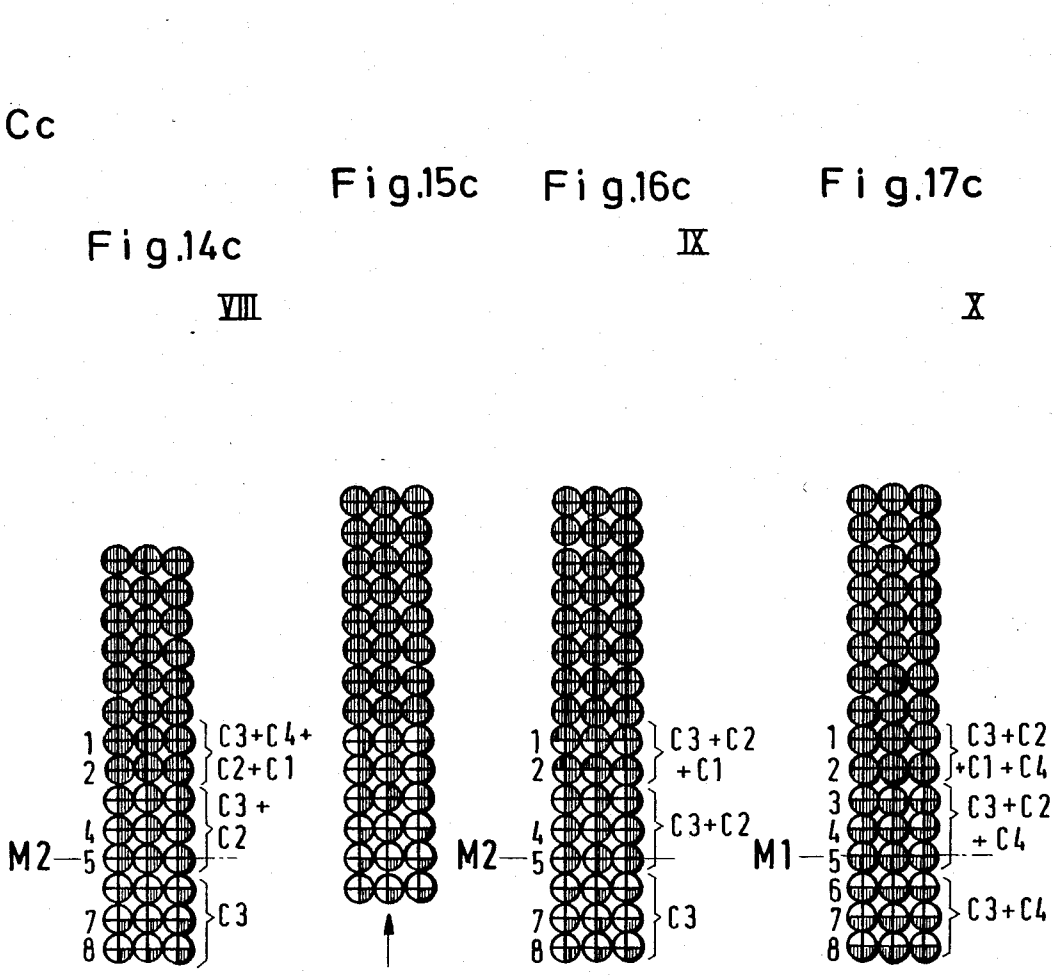

The next step is again preceded by the paper advance at the two dot diameter step length as shown in FIG. 13*c*; the ribbon position remains M2 and now the eighth pass uses again six needles, namely needles 1 and 2 cooperating with the color area C1, needles 4 and 5 cooperate with color areas C2, and the needles 7 and 8 cooperate with the color areas C3, as shown in FIG. 14*c*. In that particular pass, those rows facing needles 1 and 2 are completed as to color. FIG. 15*c* illustrates another paper advancing step at the usual length of two dot diameter, the ribbon position remains M2 and the ninth pass as per FIG. 16*c* uses the needles 1 and 2 in cooperation with the color field C1 while the needles 4 and 5 cooperate with C2 and needles cooperate with color field C3 just as in pass 4.

After the ribbon has been shifted into the position M1 the tenth pass occurs as shown in FIG. 17*c* using exclusively the color field C4, eight needles 1 through 8 participate in that particular step. Here, two rows of dots are completed by the particular needles 1 and 2 while the others are supplemented to the extent desired. After the tenth pass, ten rows of dots are completed and the operation continues as long as desired. Basically, one can say that in continuous operation and after, so to speak, the steady state has been attained, one needs five printing passes for completing eight rows of dots.

The invention is not limited to the embodiments described above, but all changes and modifications thereof, not constituting departures from the spirit and scope of the invention are intended to be included.

I claim:

1. Method of multicolor printing under utilization of a print head having at least one vertical column of print styli and cooperating with a print medium through impact printing comprising the steps of:

using a four color band ink ribbon and changing its print position so that in first and second ribbon positions the center of the column of styli is respectively centered on boundaries between the upper two bands and between the lower two bands;

printing in a plurality of passes of the print head along a print line wherein after each pass in which the print position of the ink ribbon is not changed the medium printed on is shifted in direction of the column while no such shift occurs after the shift of the ink ribbon in the direction of the column to place different bands in front of said styli, and providing an alternating sequence for the two ribbon positions in two sequential passes which is followed by paper shifting for the next pass, and repeating the sequence so that a steady state cycle includes two passes for printing with no medium shift and one pass preceded by medium shift.

2. Method of multicolor printing under utilization of a print head having at least one vertical column of print styli and cooperating with a print medium through impact printing comprising the steps of:

using a multicolor band ribbon with one wide and two narrow bands and changing its position;

printing in a plurality of passes wherein after each pass in which the ink ribbon is not changed as its position, the medium printed on is shifted in direction of the column while no such shift occurs after a position change of the ink ribbon in the direction of the column to place a different band or bands in front of said styli, including operating the printer in a first position of the ink ribbon in which the center of the column of styli is centered on a boundary between the two narrow bands and a second position in which the column of styli faces the wide band; and wherein three passes occur, each preceded by a vertical paper shift in each instance and in the first position of the multicolor band ribbon which three passes are followed by one pass in the second position of the ink ribbon not preceded by a vertical paper shift and in cyclic repetition as to the four passes, so that a steady state cycle includes at least one pass for printing with no medium shift and at least one pass with medium shift.

3. Method of multicolor printing under utilization of a print head having at least one vertical column of print styli and cooperating with a print medium through impact printing comprising the steps of:

using a four color band ribbon with one wide and three narrow color bands and selectively changing the position of the ribbon;

printing in a plurality of passes of the print head along a line wherein after each pass in which the ink ribbon is not changed in position the medium printed on is shifted in a direction of the column while no such shift occurs after the shift of the ink ribbon in the direction of the column to place a different band or bands in front of said styli including, operating the printer in a first ribbon position wherein the column of styli faces all three narrow bands and in a second position in which the column of styli faces the wide band; and operating the printer in a first portion of a print cycle in which for the first position of the ribbon a print pass is followed by a medium shift pass and in alternating sequence and at the end of the cycle the ink ribbon is shifted to the second position without vertical paper shift for the last pass of the cycle, the cycles being repeated.

4. Method as in claim 3 wherein for startup print passes and medium shift alternate while the ribbon is in the first position for four passes followed by change to the second position followed by a shift and a return to the first position for steady operation.

5. Method of multicolored printing under utilization of a print head having at least one vertical column of print styli cooperating with a medium to be printed on comprising the steps of:

using a multicolor band ink ribbon having one wide color band and two or more narrow bands;

printing in a plurality of passes of the print head along a line at arranged in cycles, wherein in one of the passes per cycle printing in the pass is followed by shifting the medium printed on in direction of the column, while for one other pass per cycle no such shift occurs, the one pass was preceded by shift of the ink ribbon in the direction of the column to place a different band or bands in front of said styli; operating the printer so that in a first print position the styli face the narrower bands and several print passes in that position each are succeeded by a vertical medium shift corresponding to the number of styli facing one narrow band in the respective preceding pass, while for one additional pass in the respective cycle the ink ribbon position is to be changed so that all styli face the wide band; and a steady state cycle includes at least one pass with no shift of the medium and at least one pass with shift of the medium.

6. Method of multicolored printing under utilization of a print head having at least one vertical column of print styli cooperating with a medium to be printed on comprising the steps of:

using an ink ribbon having four bands;

printing in a plurality of passes arranged in cycles wherein in one of the passes per cycle printing in the pass is followed by shifting the medium printed on in direction of the column, while for one other pass per cycle no such shift occurs;

preceding by the shifting the ink ribbon in the direction of the column to place different bands in front of said styli; operating the ribbon to alternate between positions in which the styli face the upper two bands and the lower two bands in alternating two-pass cycles, and advancing the medium vertically after each such cycle; and wherein a steady state cycle includes at least one pass with no shift of the medium and at least one pass with shift of the medium.

* * * * *